US008141700B2

(12) United States Patent
Simonian et al.

(10) Patent No.: US 8,141,700 B2
(45) Date of Patent: Mar. 27, 2012

(54) BOTTLE CAP FOR DISPERSING POWDERED SUPPLEMENT IN SITU

(75) Inventors: Christopher H. Y. Simonian, Sherman Oaks, CA (US); Jeannine Simonian, Sherman Oaks, CA (US); Ian J. Fettes, June Lake, CA (US)

(73) Assignee: Tap The Cap, Inc., Sherman Oaks, CA (US)

( * ) Notice: Subject to any disclaimer, the term of this patent is extended or adjusted under 35 U.S.C. 154(b) by 0 days.

(21) Appl. No.: 12/983,813

(22) Filed: Jan. 3, 2011

(65) Prior Publication Data

US 2011/0290678 A1 Dec. 1, 2011

Related U.S. Application Data

(63) Continuation-in-part of application No. 12/789,861, filed on May 28, 2010.

(51) Int. Cl.
*B65D 25/08* (2006.01)

(52) U.S. Cl. ..... 206/221; 215/227; 215/DIG. 8; 222/145.5; 222/525

(58) Field of Classification Search ..... 206/219–221, 206/568; 215/6, 10, 227, DIG. 8; 222/145.1, 222/145.5, 145.6, 129, 325, 525, 544, 566
See application file for complete search history.

(56) References Cited

U.S. PATENT DOCUMENTS

| | | | | |
|---|---|---|---|---|
| 2,793,776 | A | | 5/1957 | Lipari |
| 2,807,384 | A | | 9/1957 | Lipari |
| 2,813,649 | A | | 11/1957 | Lipari |
| 3,019,932 | A | | 2/1962 | Singiser |
| 3,156,369 | A | | 11/1964 | Bowers et al. |
| 3,840,136 | A | | 10/1974 | Lanfranconi et al. |
| 3,924,741 | A | * | 12/1975 | Kachur et al. ..... 206/221 |
| 4,195,730 | A | | 4/1980 | Hunt |
| 4,221,291 | A | | 9/1980 | Hunt |
| 4,712,715 | A | * | 12/1987 | Fischer ..... 222/145.5 |
| 4,727,985 | A | | 3/1988 | McNeirney et al. |
| 4,793,475 | A | | 12/1988 | Itzel |
| 4,865,189 | A | * | 9/1989 | Guerra et al. ..... 206/221 |
| 4,911,316 | A | | 3/1990 | Tackles |
| 5,029,049 | A | | 7/1991 | Ladyjensky |
| 5,060,791 | A | * | 10/1991 | Zulauf ..... 206/221 |
| 5,419,445 | A | | 5/1995 | Kaesemeyer |
| 5,678,720 | A | | 10/1997 | Van Melle |
| 5,927,549 | A | | 7/1999 | Wood |
| 5,971,140 | A | | 10/1999 | Frutin |
| 6,113,257 | A | | 9/2000 | Sharon et al. |

(Continued)

FOREIGN PATENT DOCUMENTS

EP 2143657 A1 1/2010

(Continued)

*Primary Examiner* — Luan K Bui
(74) *Attorney, Agent, or Firm* — Law Offices of David L. Hoffman

(57) ABSTRACT

A dispensing cap system for dispensing a supplement material through a bottle neck opening and into the bottle. An exemplary embodiment includes a cap member configured for connection to beverage bottle necks of different sizes. A seal member is arranged to provide a liquid seal against the neck opening. A valve member passes through a storage member attached to the cap member, and is configured for movement between a storage position and a dispensing position, in which passage is permitted of the supplement material from the storage member into the bottle. A nipple member may be positioned over the valve member to allow the bottle contents to be utilized or consumed.

20 Claims, 17 Drawing Sheets

U.S. PATENT DOCUMENTS

| | | | | |
|---|---|---|---|---|
| 6,138,821 | A | 10/2000 | Hsu | |
| 6,152,296 | A | 11/2000 | Shih | |
| 6,257,428 | B1 | 7/2001 | Caola | |
| 6,372,270 | B1 | 4/2002 | Denny | |
| 6,513,650 | B2 | 2/2003 | Mollstam et al. | |
| 6,527,110 | B2 | 3/2003 | Moscovitz | |
| 6,533,113 | B2 | 3/2003 | Moscovitz | |
| 6,540,070 | B1 | 4/2003 | Conwell | |
| 6,609,612 | B2 | 8/2003 | Vlodek | |
| 6,702,161 | B2 | 3/2004 | Adams et al. | |
| 6,705,462 | B2 | 3/2004 | Kasuya | |
| 6,766,903 | B1 | 7/2004 | Yehhsu | |
| 6,786,330 | B2 | 9/2004 | Mollstam et al. | |
| 6,820,740 | B1 | 11/2004 | Spector | |
| 6,854,595 | B2 | 2/2005 | Kiser | |
| 6,921,087 | B2 | 7/2005 | Takahashi et al. | |
| 6,926,138 | B1 | 8/2005 | Basham et al. | |
| 6,935,493 | B2 | 8/2005 | Cho | |
| 6,959,841 | B2 | 11/2005 | Vlodek | |
| 6,962,254 | B2 | 11/2005 | Spector | |
| 6,974,024 | B2 | 12/2005 | Cho | |
| 6,994,211 | B2 | 2/2006 | Cho | |
| 7,070,046 | B2 | 7/2006 | Cho | |
| 7,172,095 | B2 * | 2/2007 | Marshall | 222/83 |
| 7,178,683 | B2 | 2/2007 | Birkmayer et al. | |
| 7,210,575 | B2 | 5/2007 | Oswald | |
| 7,347,322 | B2 | 3/2008 | Cho | |
| 7,484,633 | B1 | 2/2009 | Moher | |
| 7,503,453 | B2 * | 3/2009 | Cronin et al. | 206/221 |
| 7,546,919 | B2 | 6/2009 | Lee | |
| 7,562,782 | B2 | 7/2009 | Yorita | |
| 7,588,142 | B1 | 9/2009 | Bush | |
| 7,607,549 | B2 | 10/2009 | Morini | |
| 7,854,104 | B2 * | 12/2010 | Cronin et al. | 206/219 |
| 2001/0035387 | A1 | 11/2001 | Sutcliffe-Noyd | |
| 2004/0154937 | A1 | 8/2004 | Cho | |
| 2005/0184024 | A1 | 8/2005 | Santa Cruz et al. | |
| 2005/0218015 | A1 | 10/2005 | Spector | |
| 2006/0283726 | A1 * | 12/2006 | McCloud | 206/219 |
| 2007/0023300 | A1 | 2/2007 | Spector et al. | |
| 2007/0215496 | A1 | 9/2007 | Scarborough | |
| 2008/0093326 | A1 | 4/2008 | Cho | |
| 2008/0116086 | A1 | 5/2008 | Hung | |
| 2008/0202950 | A1 | 8/2008 | Anderson | |
| 2008/0223485 | A1 | 9/2008 | Nyambi et al. | |
| 2008/0223740 | A1 | 9/2008 | Ramsey et al. | |
| 2008/0223741 | A1 | 9/2008 | Nyambi et al. | |
| 2008/0289976 | A1 | 11/2008 | Henry | |
| 2009/0236303 | A1 | 9/2009 | Lizerbram et al. | |
| 2009/0260690 | A1 | 10/2009 | Bell | |
| 2009/0308831 | A1 | 12/2009 | Anderson | |

FOREIGN PATENT DOCUMENTS

| | | | |
|---|---|---|---|
| GB | 2471994 | A | 1/2011 |
| JP | 2002211622 | A | 7/2002 |
| JP | 2006124008 | A | 5/2006 |
| JP | 2006124009 | A | 5/2006 |
| JP | 2006131283 | A | 5/2006 |
| WO | WO2010004486 | A1 | 1/2010 |
| WO | WO2010028172A1 | A1 | 3/2010 |
| WO | WO2011098865 | A1 | 8/2011 |

* cited by examiner

BOTTLE CAP FOR DISPERSING POWDERED SUPPLEMENT IN SITU

CROSS REFERENCE TO RELATED APPLICATION(S)

This application is a CIP of U.S. patent application Ser. No. 12/789,861, filed May 28, 2010, and which is incorporated by reference herein.

BACKGROUND OF THE INVENTION

Addition of powdered supplements to a beverage container is becoming increasingly popular. For example, powdered supplements may be stored in an assembly which is fitted to the neck of the container, to release the supplement into a container of water, to be consumed by the user. The assemblies can be expensive to manufacture, and typically are designed to fit a specific container size.

SUMMARY OF THE INVENTION

In one embodiment, there is a dispensing cap system for dispensing a supplement material through a bottle neck opening and into the bottle. The system may include the cap system along with the bottle, or just the cap system. The system may also be combined with supplement stored therein or without supplement therein to be filled later by a user.

An exemplary embodiment includes the cap member, which is configured with circumferentially arranged fingers at a lower end for connection to beverage bottle necks of different sizes, e.g., by engaging threads on the bottle neck. A seal member preferably of rubber is arranged to provide a liquid seal against the bottle's mouth or neck opening, and to fit inside the member. The cap member also has a storage member connected to it, and/or forms or is part of a storage compartment, where the supplement may be kept until use.

The cap system also includes a nipple for drinking liquid from the bottle, the nipple being of similar configuration to a standard water bottle or sports bottle nipple. There is also a valve member, preferably cylindrical and hollow, having an upper portion preferably inside the nipple, and a lower portion with an opening or openings for communicating the storage compartment and thus the supplement with contents of the bottle. The valve passes through the storage member or compartment which is positioned around the valve, and is configured for movement between a storage position and a dispensing position, in which passage is permitted of the supplement material from the storage member into the bottle for mixing with the bottle's contents. The valve is preferably normally closed, i.e., normally in the storage position, and preferably actuated by pressing down on the nipple until the valve's opening or openings are registered with the storage compartment, i.e., the dispensing position. The bottle may then be shaken to mix the liquid and supplement, and then the user may move the nipple fully upward to a drinking position.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1A:
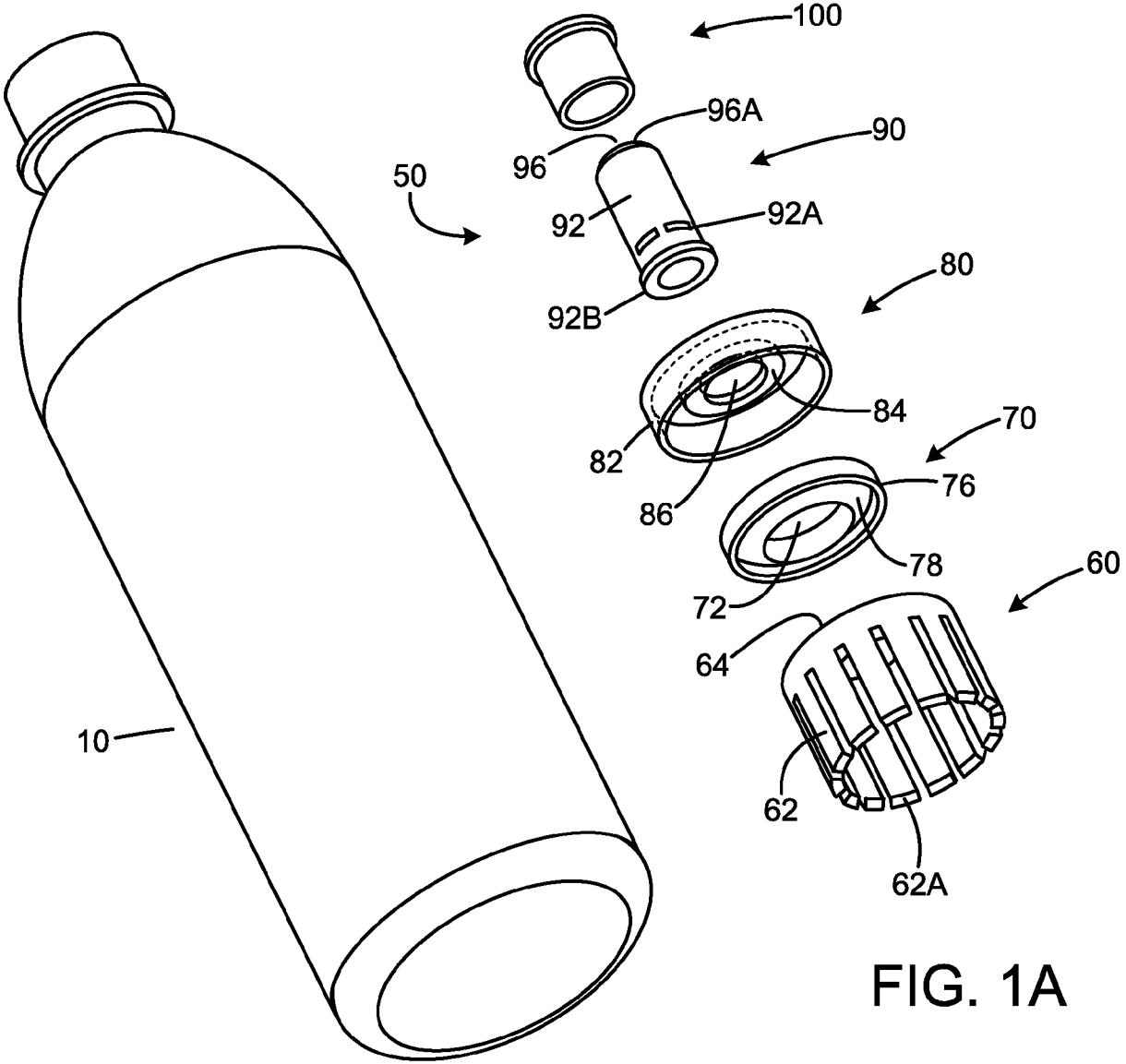
FIGS. 1A-1C are exploded views of an exemplary embodiment of a bottle cap dispensing system.

In the following detailed description and in the several figures of the drawing, like elements are identified with like reference numerals.

One exemplary embodiment is directed to a bottle cap assembly, configured to fit beverage bottles of different neck dimensions, and to dispense a liquid or solid additive such as a nutritional supplement into the bottle contents. For example, the bottle cap assembly may be configured to fit onto both an Evian® water bottle of a relatively larger neck size and an Arrowhead® water bottle with a somewhat smaller neck size. In another embodiment, the bottle cap assembly is configured to fit onto at least three water bottles of different sizes. These exemplary embodiments includes a valve which the user pushes or pulls to release a supplement in powdered or liquid form into the bottle contents, and also remains in place for the user to drink through. The valve also closes and opens to allow the user to seal the bottle or drink from the bottle. Once the bottle contents have been consumed, the bottle cap is typically not re-used, in an exemplary embodiment. However, it could be cleaned and re-used, if desired.

Figure 1B:
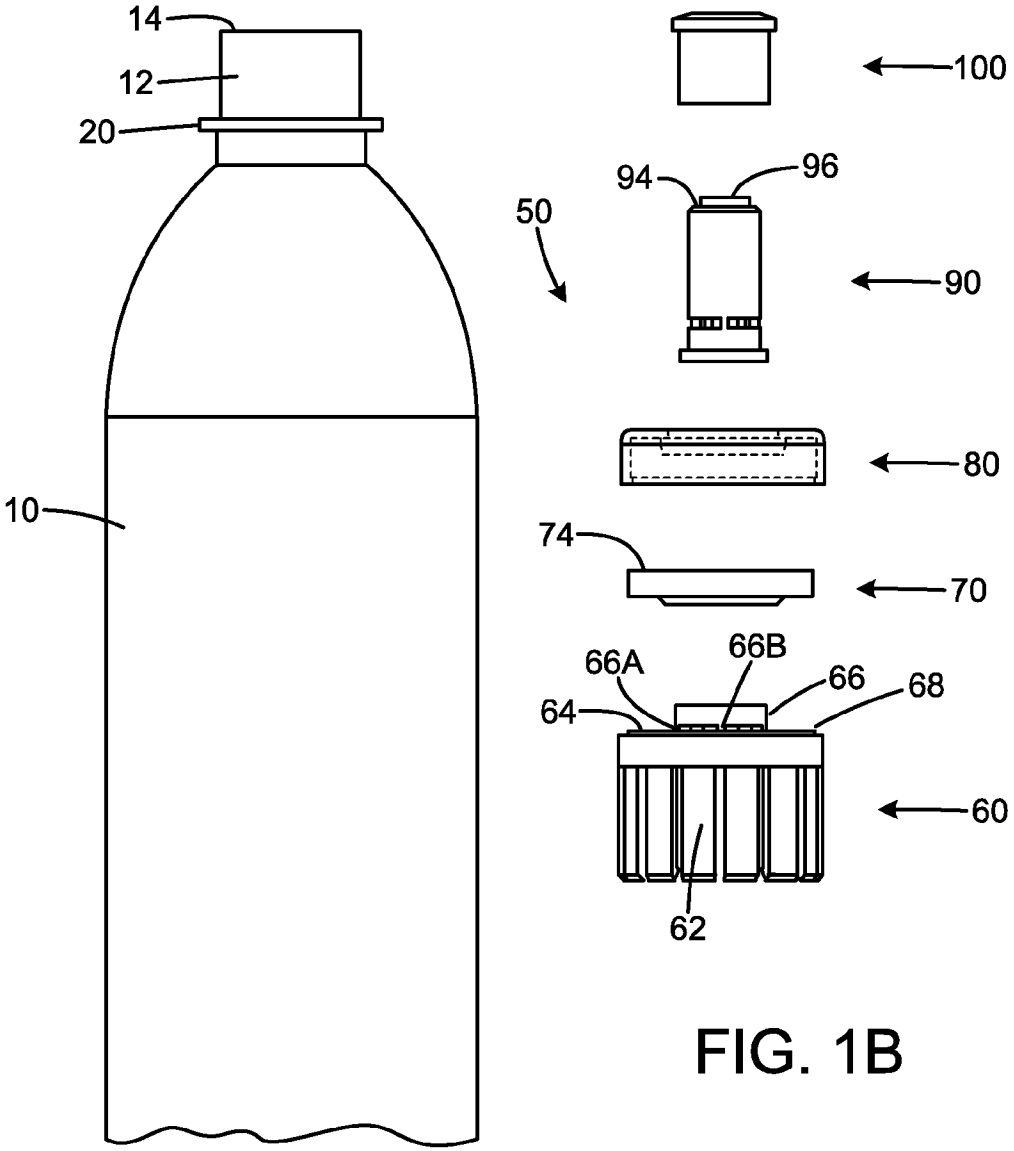
Figure 1C:
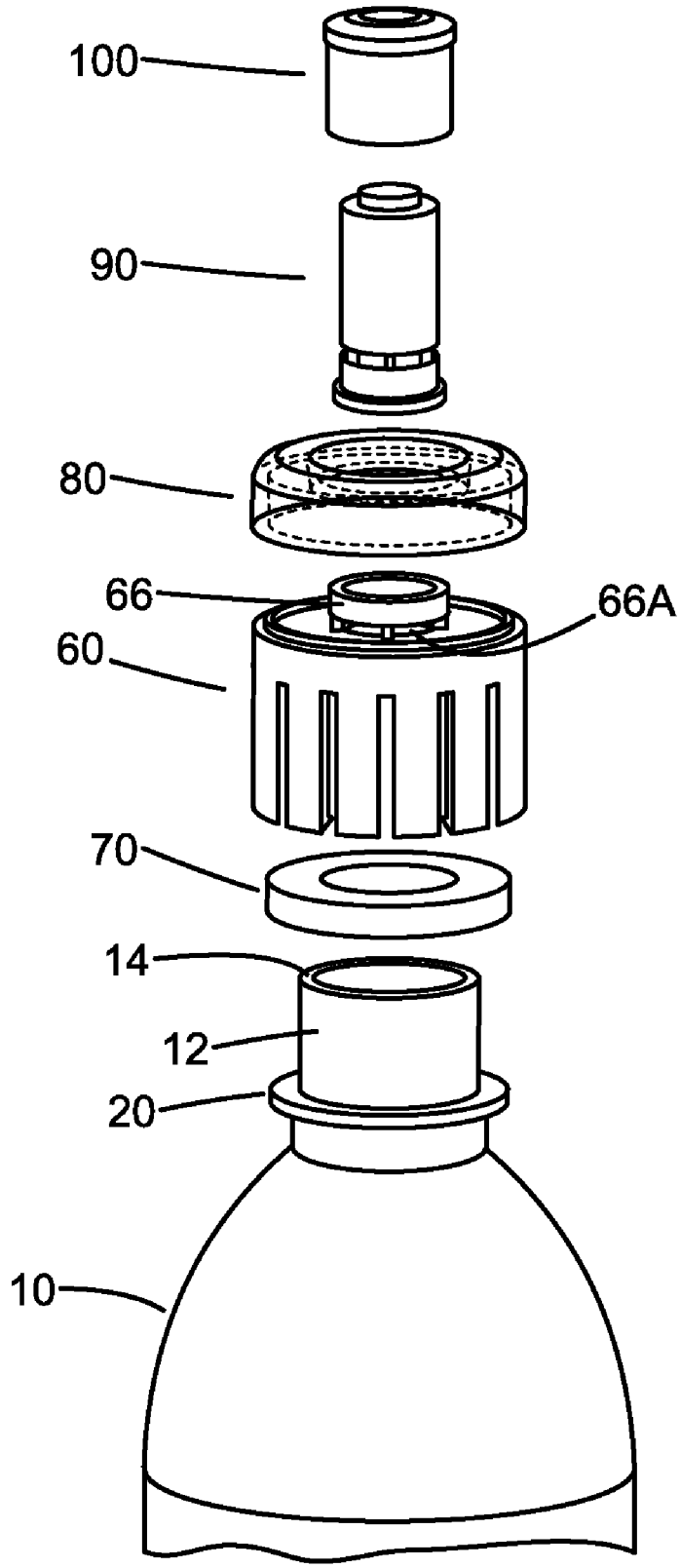

FIGS. 1A-1C are exploded views of an exemplary embodiment of a dispensing cap system 50. The cap system is configured to seal to the mouth of a beverage bottle 10. In a typical embodiment, the bottle neck may have threads to allow a conventional threaded bottle cap or bottle cap and valve to be attached by threading to the bottle. The cap system 50 in such a case would be attached to the bottle neck after the conventional bottle cap has been removed. For simplicity, the threads on the bottle neck, above the neck flange, are not shown in the figures. The cap system 50 includes a cap member 60 generally having a plurality of finger portions 62 projecting from a web portion 64. The distal ends of the finger portions terminate in inwardly projecting barb or tab portions 62A, which may have sloped surfaces. The web portion has a hollow upwardly projecting boss portion 66, i.e. projecting above the web portion away from the finger portions. The boss portion 66 has a plurality of spaced dispensing openings 66A formed adjacent the web surface between ribs 66B, and these openings will allow the supplement material to pass through, as described more fully below.

The cap member 60 may be fabricated of a plastic material such as polyethylene, polypropylene, polysterene, styrene, ABS, Delrin™ or Nylon™, and the finger portions are thin and have some flexibility. The cap member and the length of the finger portions is sized so that the tips of the finger portions may flex outwardly as the cap member is pushed onto the neck 12 of the bottle, and the barb portions engage under the flange 20 extending from the bottle neck. The cap member further includes a circumferential vertical rib 68 extending upwardly from the web portion 64, of a smaller diameter than the diameter of the web portion, to provide an attach feature for attaching structure 80, described below. In this embodiment, cap member 60 includes a connection structure for non-threading connection of the cap system to a beverage bottle, by engagement with the bottle flange or collar. In this embodiment, the connection structure includes the finger portions and the barb portions. This type of connection structure does not have to match the threads of the bottle neck, which may vary with different beverage vendors and/or bottle types. The number of finger portions may vary in other embodiments. For example, fewer and relatively more rigid finger portions may be used. In other embodiments, the connection structure may include finger portions with barbs or teeth which engage the threads on bottle neck by sliding over some or all the threads as the cap system is pushed onto the bottle neck, and locking in place without rotationally being threaded onto the threads of the bottle. A small or slight turn of the cap system when the barbs slide of the threads of the bottle neck may help secure the cap system and limit any play in the combination of the cap system and bottle.

The cap system also includes a seal member 70, shown for clarity in FIGS. 1A-1B above the cap member 60, but actually sized to fit within the barrel of the cap member. The seal member is preferably fabricated of an elastomeric material, such as, by way of example only, silicone rubber, SBR, neoprene rubber, thermoplastic rubber (TPR) (molded rubber) or closed cell foam, and has a center opening configured for concentricity with the opening through the boss. Other features of the seal member will be discussed below. Preferably, in all embodiments, the seal material is relatively compliant, e.g., preferably between 15 and 30 shore hardness, e.g., about 25 shore. Other shore values are not necessarily excluded.

A supplement storage member 80 is configured for attachment to web portion of the cap member, and, as will be described more fully below, defines the outer periphery of a storage volume for a quantity of a supplement in granular, powder or liquid form. The storage member in this embodiment is a generally cup-like member, with a generally cylindrical sidewall portion 82 and a web portion 84 having an opening 86 formed therein. The storage member 80 may be fabricated of a semi-transparent or transparent plastic material such as, by way of example only, styrene, and is configured for attachment to the cap member by snap fit, adhesive, welding or other connection method. For example, the cap 60 top web surface may have a peripheral ridge with groove extending above the web portion 64, which may be engaged in a snap fit by an inwardly extending corresponding feature on the bottom of the wall portion 82.

The dispensing cap system 50 further includes a shuttle valve member 90 having a hollow generally cylindrical wall portion 92, and a top web portion 94 at one end thereof which extends across the end of the wall portion. A bottom flange 92B is formed at the distal end of the wall portion, and has an outer diameter larger than the diameter of the opening in the storage member 80. A tip 96 of reduced diameter relative to the wall portion 92 extends above the surface of the web portion 94. The sidewall of the tip has several ports 96A formed therein, and permit the beverage to pass through from the bottle when the valve is in an open position. The diameter of the wall portion 92 is sized in cooperation with the diameter of the opening 86 in the storage member, so that the cylindrical wall portion tightly fits within the opening in a sliding or even interference fit.

A nipple member 100 is sized to fit over the shuttle valve. The shuttle valve has a range of sliding movement within the storage member, and the nipple has a range of sliding movement on the shuttle valve, such that, when the nipple is in a closed position as in FIG. 2, the ports 96A are sealed by the nipple. In an open position as in FIG. 3, the nipple does not cover the ports 96A, allowing liquid to pass through from the bottle, so the user can drink the beverage.

Figure 2:
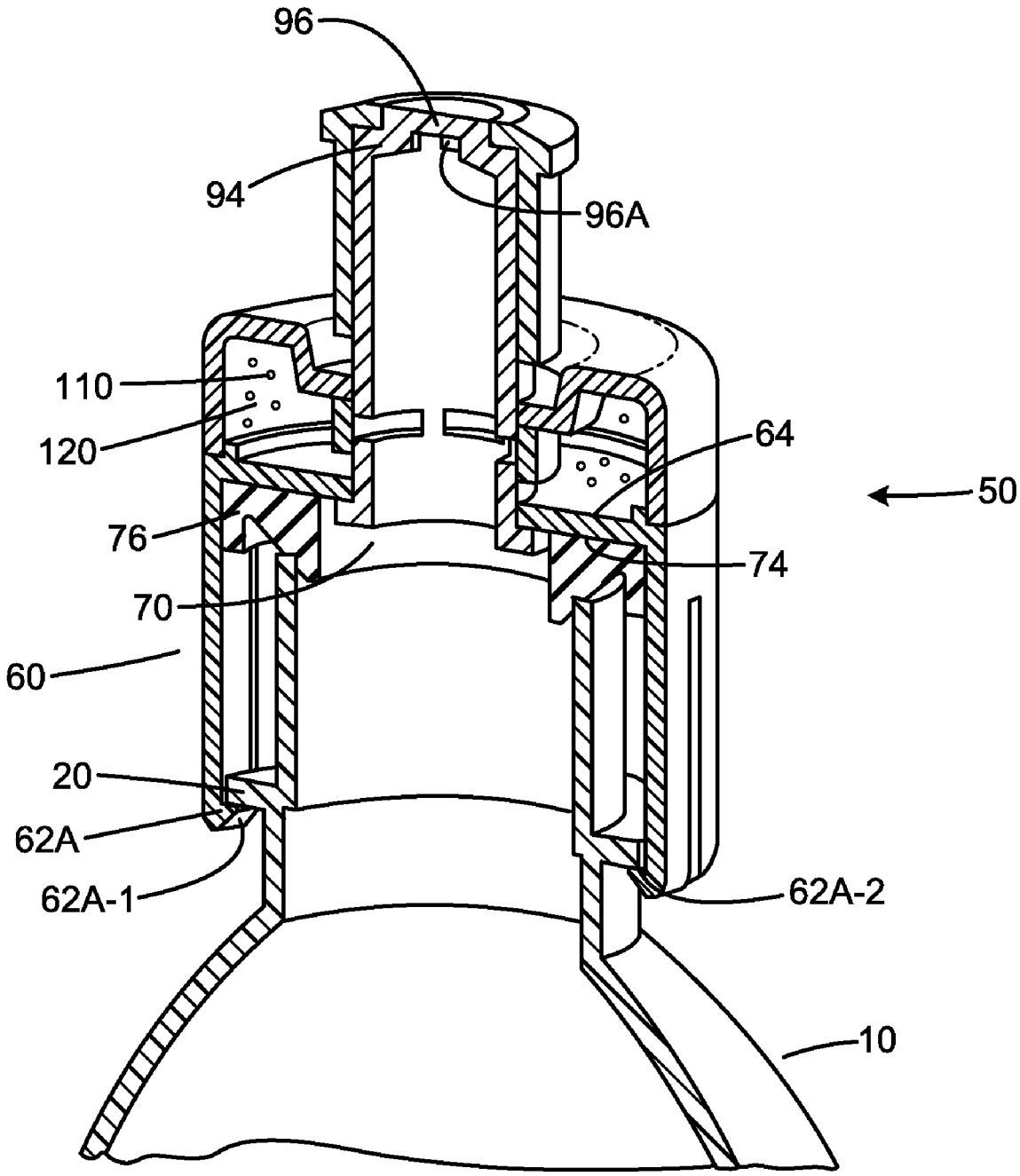
FIG. 2 is a cutaway view of an exemplary dispensing cap system as installed on a bottle, with the system in a filled state.

FIG. 2 is a cutaway view of the dispensing cap system 50 as installed on a bottle 10, with the system 50 in a filled state as delivered to the user. In this state, the valve 90 is positioned so that the lower flange 92B is in contact with the lower surface of the web portion 64 of the cap member, and the nipple is in a closed position relative to the nipple. The interior volume 110 of the storage member 80 has been filled with a quantity of supplement material 120. The openings 92A in the nipple are blocked by the solid wall portion of the boss 66, preventing the supplement material from passing through the openings 92A.

Still referring to FIG. 2, the system 50 is installed on the bottle 10, with the barbed tips 62A of the finger portions 62 having been pushed over the bottle flange 20, with the angled surfaces 62A-1 facilitating the installation by transferring a flexing force tending to splay the tips 62A outwardly as user pushes the cap system 50 downwardly over the neck of the bottle and the surfaces 62A-1 contact the flange edge. Continued downward pressure on the cap system results in the seal 70 coming into contact with the top lip of the neck and compressing somewhat to seal against the top lip of the opening. The barbed tips 62 then pass over the flange and lock the cap system in place by engagement of the horizontal surfaces 62A-2 with the underside of the flange.

The seal member 70 includes a center opening 72 through which the bottle contents may pass, and a generally flat upper surface 74. The outer periphery of the seal includes a downwardly extending peripheral wall 76. The lower surface of the seal defines a tapered surface 78 defining a partial conical seal surface which may be contacted by the bottle neck lip when the cap system is attached to the bottle neck. The conical seal surface has sufficient width relative to the bottle opening to seal a range of neck sizes, and also provide some adjustment to differences in the distance between the bottle neck flange and the top of the neck.

Figure 3:
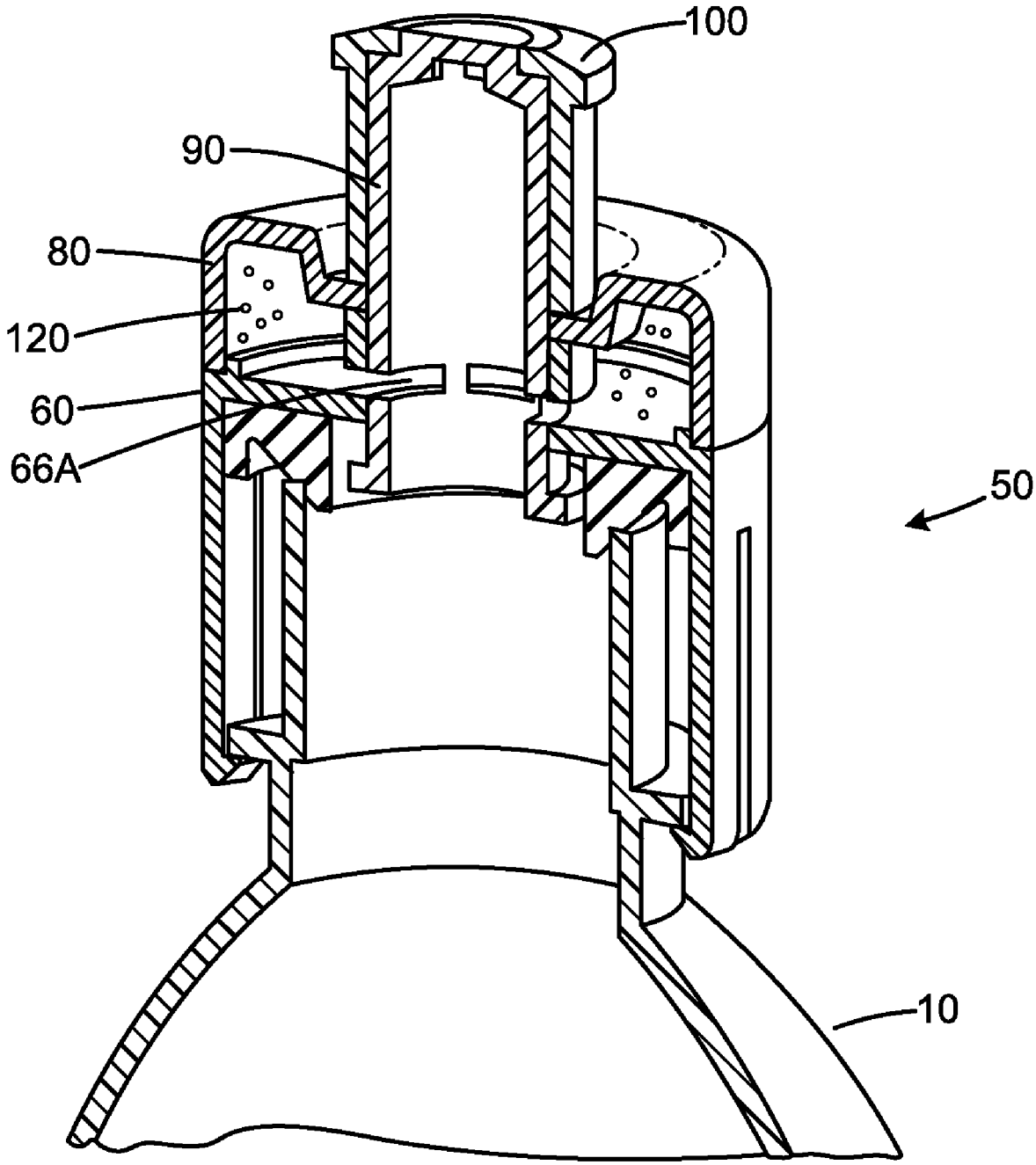
FIG. 3 is a cutaway view similar to FIG. 2, but with the valve member in a dispensing state or position.

FIG. 3 is a cutaway view similar to FIG. 2, but with the shuttle valve 90 pushed downwardly, with the bottom end of the nipple 100 contacting the surface of the storage member 80. In the position or dispensing state shown in FIG. 3, the ports 92A in the valve member are at least partially aligned with the slot openings 66A formed in the cap member boss 66. The supplement material 120 is dispensed through the aligned openings and ports, and into the liquid in the bottle 10. The nipple 100 is still in a closed position relative to the valve 90, so that the contents of the bottle cannot be drawn through the valve 90. Depending on the tightness of the fit between the storage member and the valve, the user may tap the nipple and valve to cause the movement between the closed state shown in FIG. 2 and the dispensing state shown in FIG. 3. With the cap system in the dispensing state as in FIG. 3, the user may shake the bottle and assembled cap system to ensure full dispensing of the supplement material from the storage member into the bottle, and facilitate dissolving or mixing of the supplement with the bottle contents.

Figure 4:
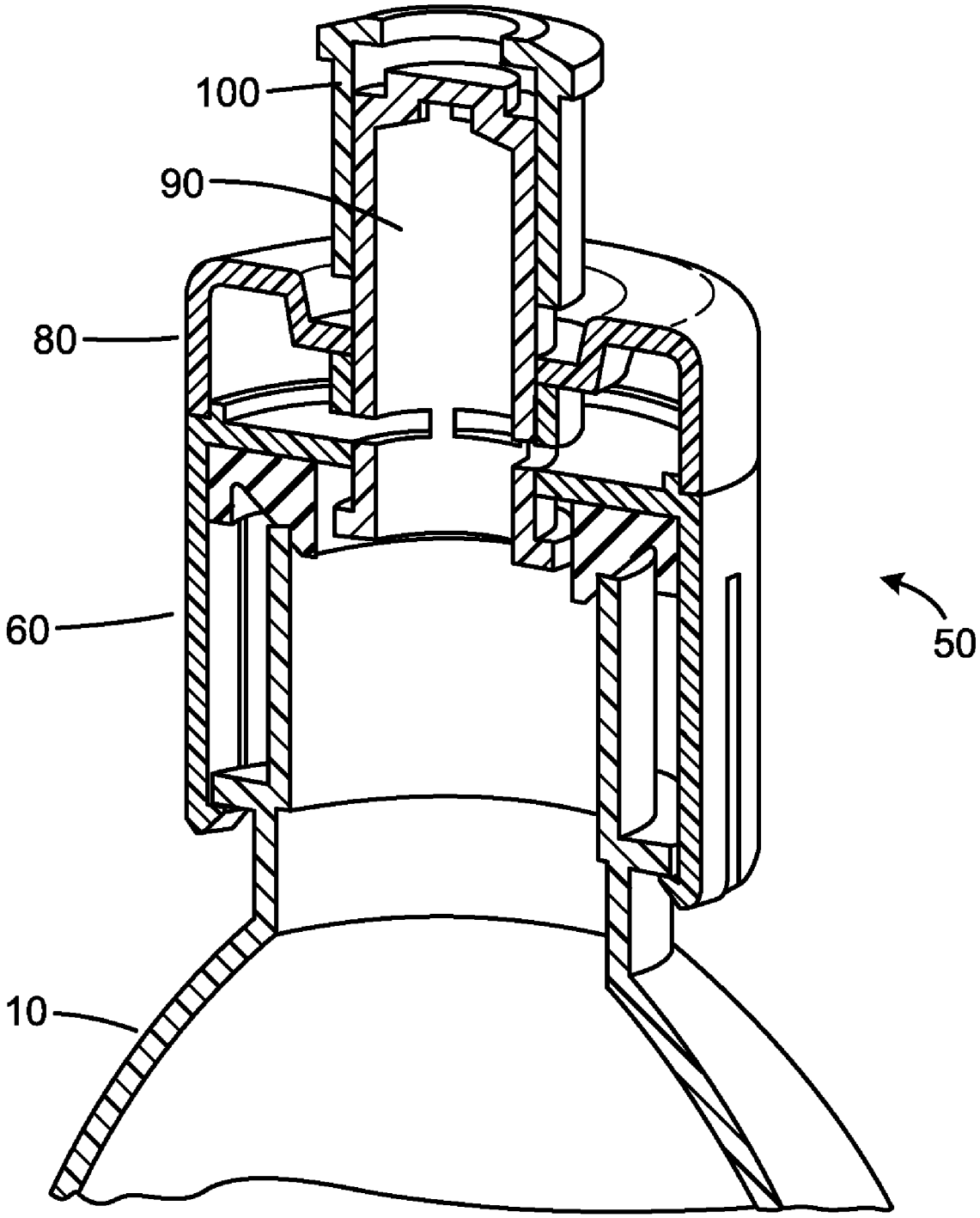
FIG. 4 is a cutaway view similar to FIG. 3, but with the cap nipple pulled up and in an open state relative to the valve member.

FIG. 4 is a cutaway view similar to FIG. 3, but with the nipple 100 pulled up and in an open state relative to the valve 90. In this position, the ports 96 on the tip of the valve are exposed, and provide ports through with the user may drink the bottle contents. In FIG. 4, the valve 90 has remained in the dispensing position relative to the storage member 80. The valve may be fitted with a projecting feature that allows the valve to be pushed from the storage position to the dispensing position, but due to engagement with the bottom of the cap member 60 is prevented from being pulled back to the storage position. Alternatively, the valve member 90 may be raised to the storage position as the nipple is opened.

Figure 5:
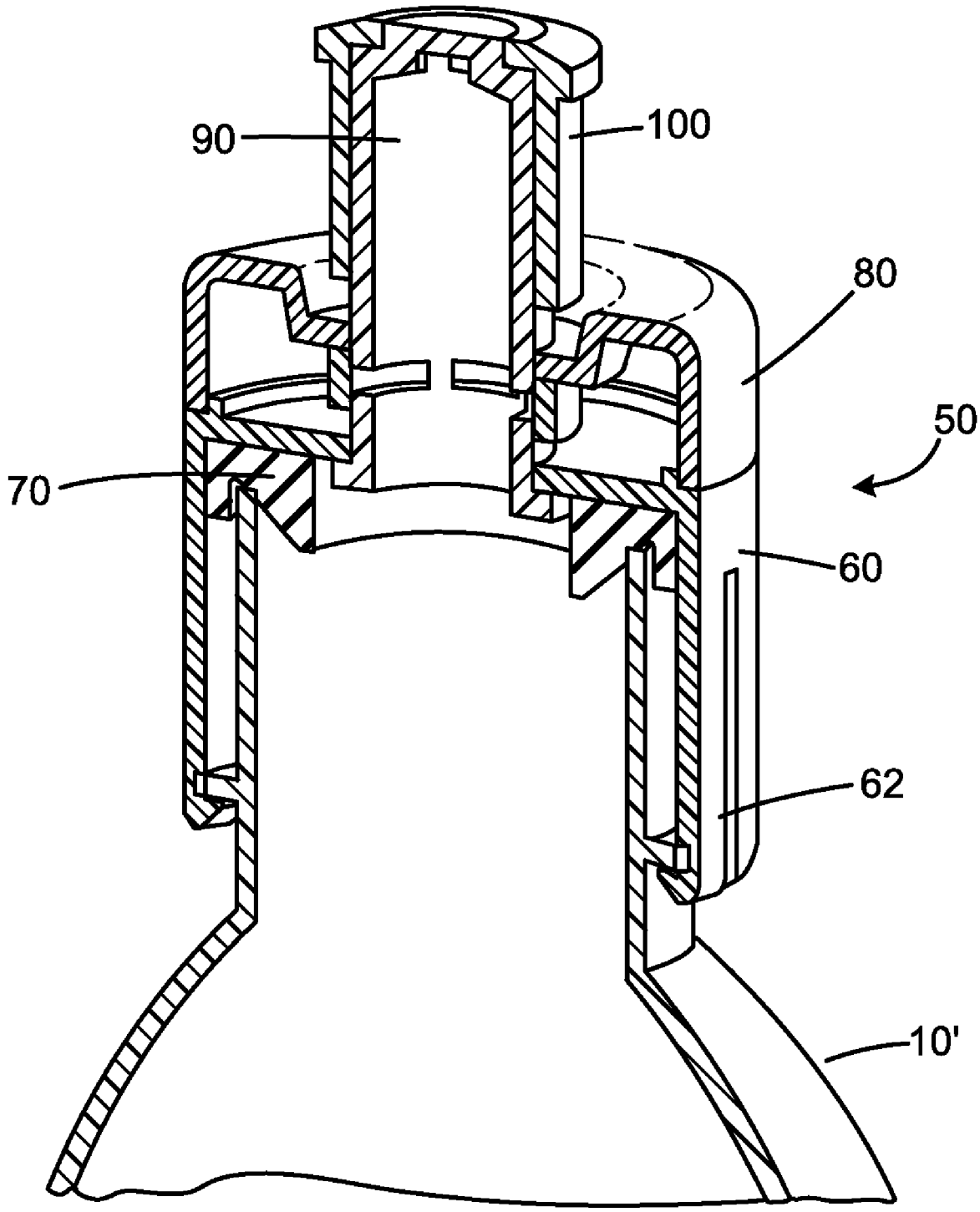
FIG. 5 is a cutaway view of a bottle of a large neck opening size in relation to the bottle shown in FIG. 2, with an exemplary embodiment of the cap system installed on the bottle neck.

FIG. 5 is a cutaway view of a bottle 10' with an exemplary embodiment of the cap system 50 installed on the bottle neck. The bottle 10' has a somewhat large neck diameter than that of the bottle 10, and yet the same cap system is configured to seal and install on the bottle neck. This is due to the use of an expandable attach system as provided by the finger portions 62 of the cap member, and the seal 70 with its seal surface broad enough to seal against necks of different sizes. In an exemplary embodiment the seal surface provided by the seal member 70 is conical, which can increase the seal pressure for larger diameter bottle neck openings, and/or accommodate differences in the distance between the top of the neck and the neck flange for different bottle types. Thus, instead of utilizing a threaded connection between the cap system and the bottle neck, a connection which accommodates different neck sizes is employed.

An exemplary embodiment of a bottle cap dispensing system may accommodate bottle necks of different dimensions, so that one cap dispensing system can be used with several bottle sizes, e.g. with different neck heights (flange to neck opening), and various bottle neck opening diameters. Exemplary ranges are from 5 mm to 25 mm (neck height range) and 18 mm to 30 mm (diameter range of bottle neck openings). A typical diameter range is from 26.5 mm to 28 mm.

Figure 6:
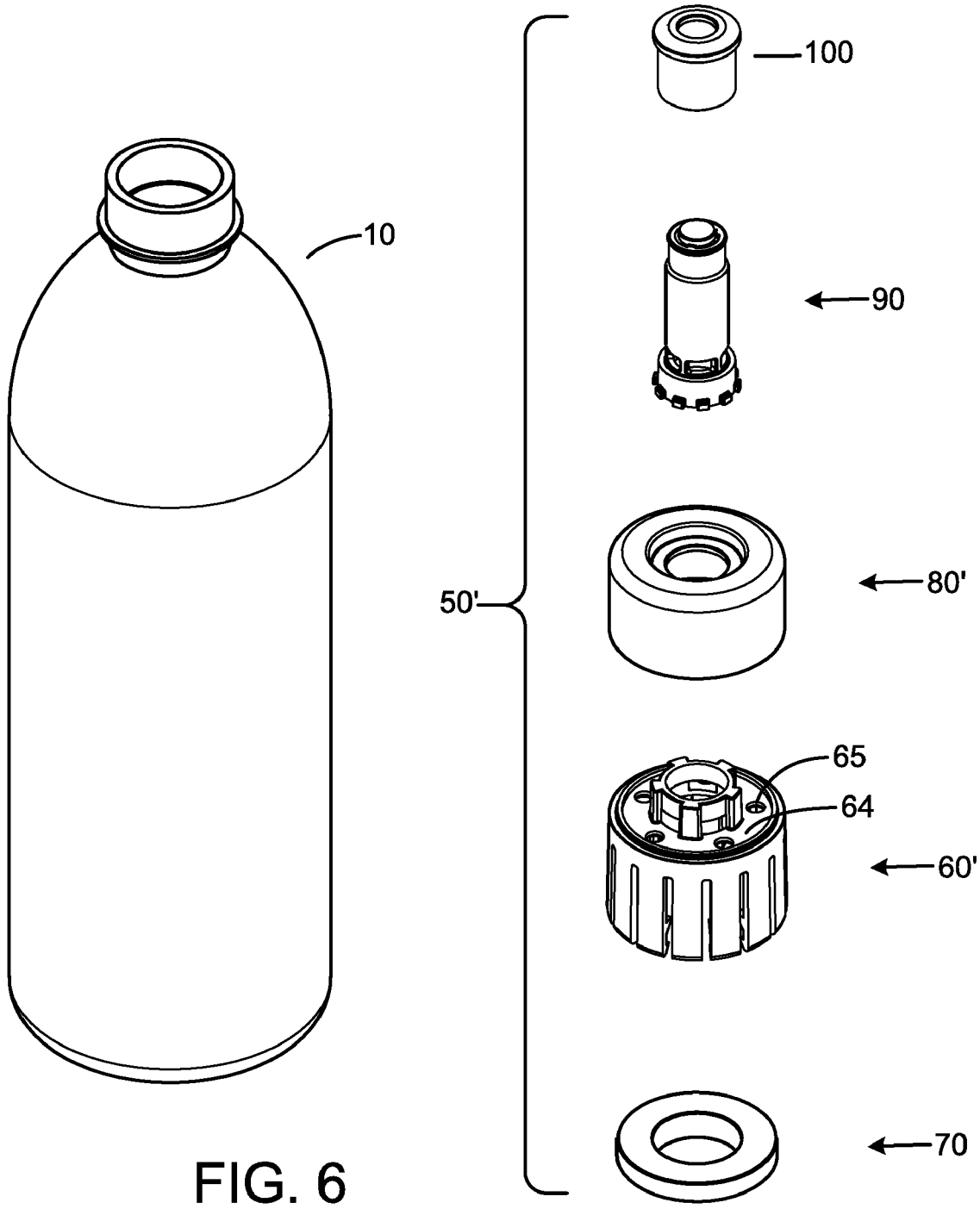
FIG. 6 is an exploded view of an alternate embodiment of a dispensing cap bottle cap dispensing system.

An alternate embodiment of a dispensing cap system 50' is illustrated in FIG. 6. The alternate embodiment is similar to the embodiment illustrated in FIGS. 1A-5. However, the cap member 60' has a plurality of fill openings 65 formed in the web surface 64. The fill openings provide a means to allow the product to be dispensed to be filled into the supplement storage member 80' after it has been attached or assembled to the cap member 60'. A liquid or powder supplement material can be loaded into the storage member through the fill openings, e.g. by pouring the supplement into the openings with the cap/storage member assembly in an inverted position. After the storage member 80' has received the supplement load, the bottle seal member 70 is inserted into the cap and pushed against the bottom of the web surface to seal the fill openings. The capacity of the storage container 80' is increased in relation to that of storage container 80 (FIGS. 1-5) by increasing the depth dimension in this exemplary embodiment.

Figure 7:
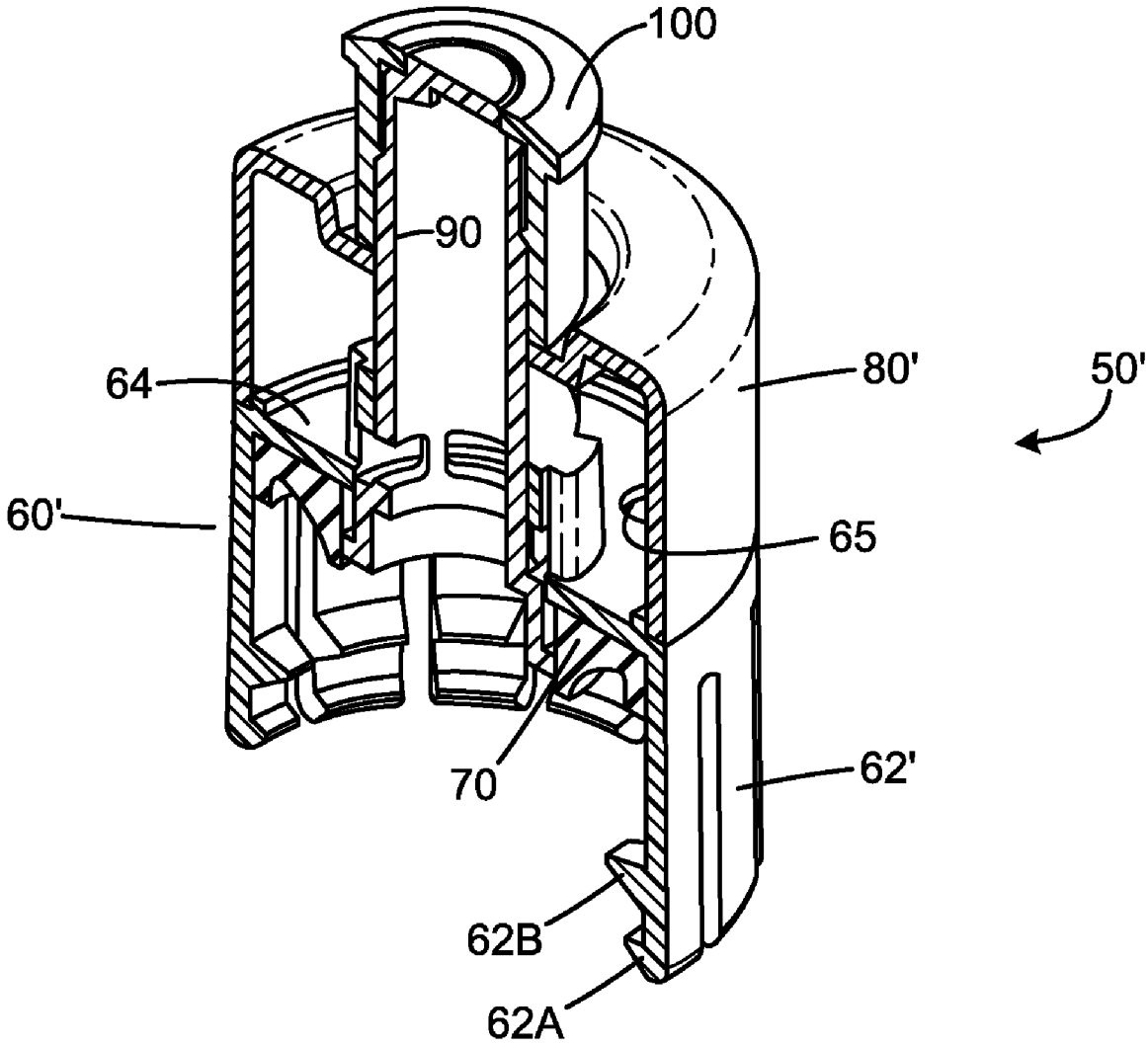
FIG. 7 is a cutaway view of the alternate embodiment of FIG. 6 in an assembled condition.

The embodiment 50' of FIG. 6 is further illustrated in the assembled, cut-away view of FIG. 7. Here the seal member 70 is shown in the seal position, closing off the fill openings 65 formed in the cap member surface 64.

FIG. 7 illustrates another feature of the bottle cap assembly 50'. Since some bottles have different neck-flange-to-neck-top-surface dimensions, at least some of the finger portions 62 of the cap member 60' are formed with two sets of barb portions, the barb tip 62A and an intermediate barb portion 62B. In the disclosed embodiment, each of the finger portions is formed with the barb tip portion and the intermediate barb portion. In other embodiments, fewer than all the finger portions may be fabricated with both, one, or none of the barb portions. Moreover, in other embodiments, some of the finger portions may have only a tip barb portion, and others may have only an intermediate barb portion.

Use of the intermediate barb portions 62B with the tip barb portions 62A enables the bottle cap assembly 50' to accommodate even more variations in the bottle neck. For bottle necks with relatively smaller distances from the bottle opening surface against which the bottle cap assembly will seal to the bottle neck flange, the intermediate barb portions 62B may engage the flange to hold the cap assembly in place. For other bottle necks with relatively larger flange distances, the barb tip portions may engage the flange to hold the cap assembly in place.

Figure 8:
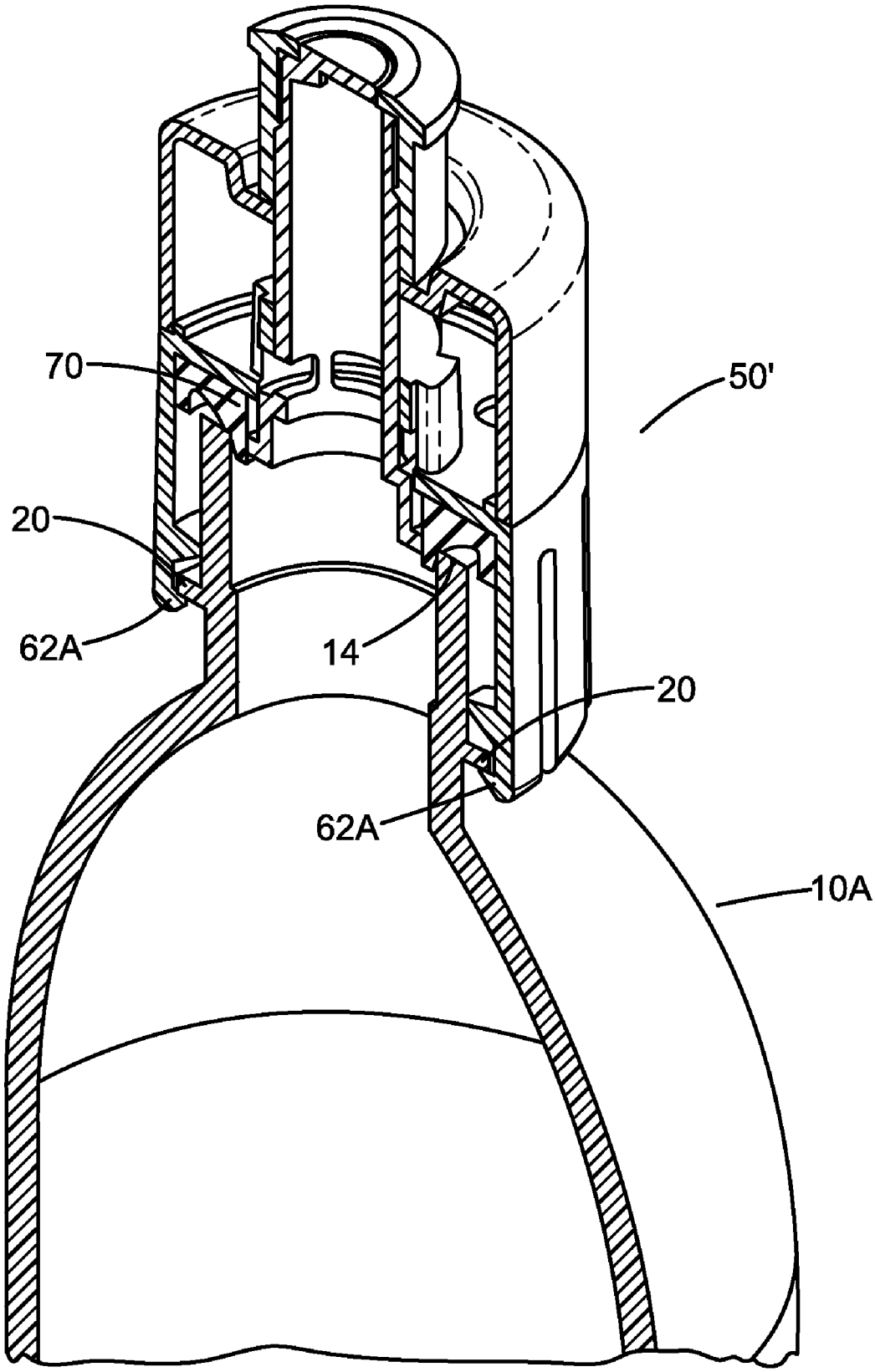
FIGS. 8, 9 and 10 are cutaway views of the alternate embodiment of FIG. 6, shown in an engaged position on three exemplary bottle types.
Figure 9:
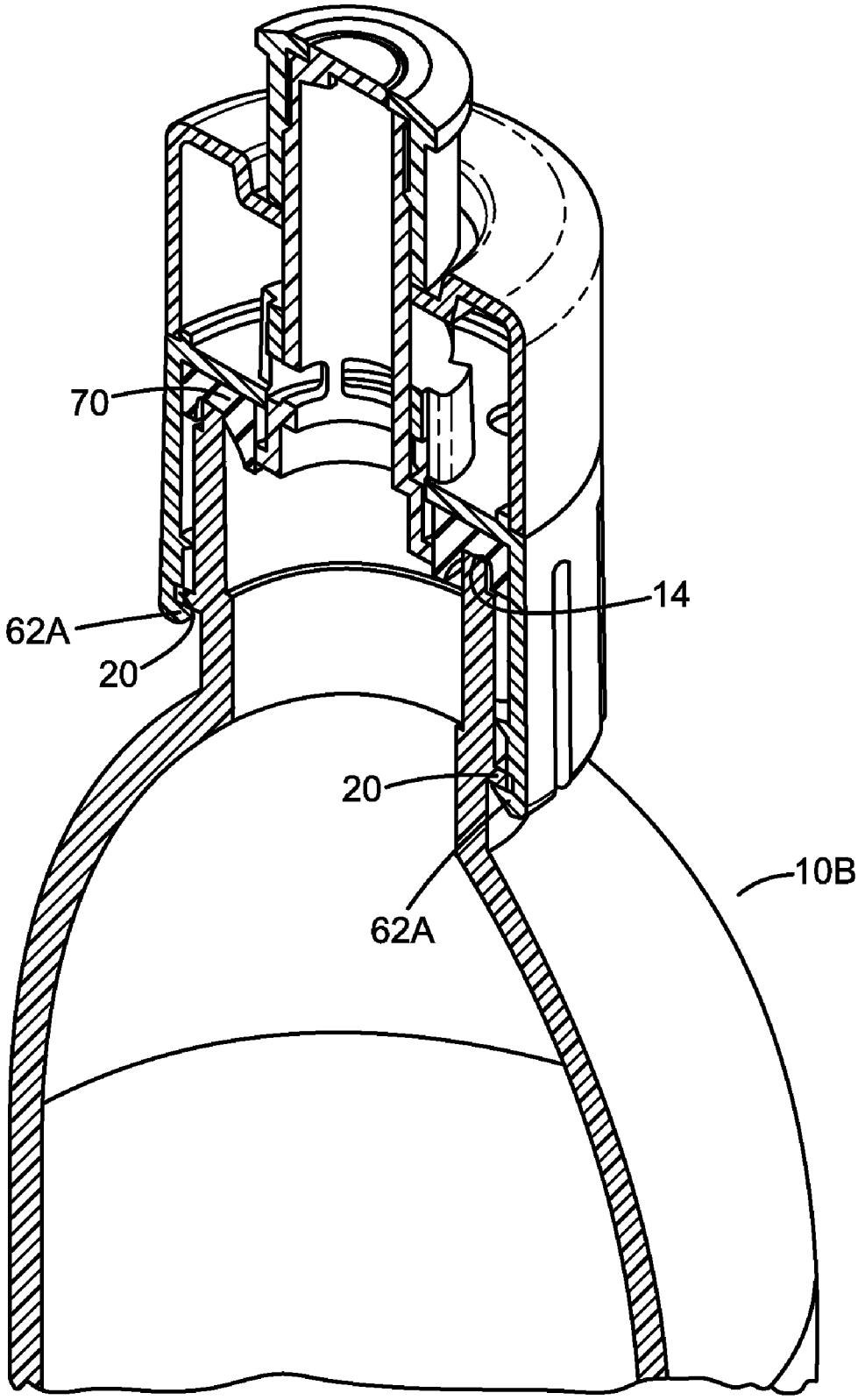
Figure 10:
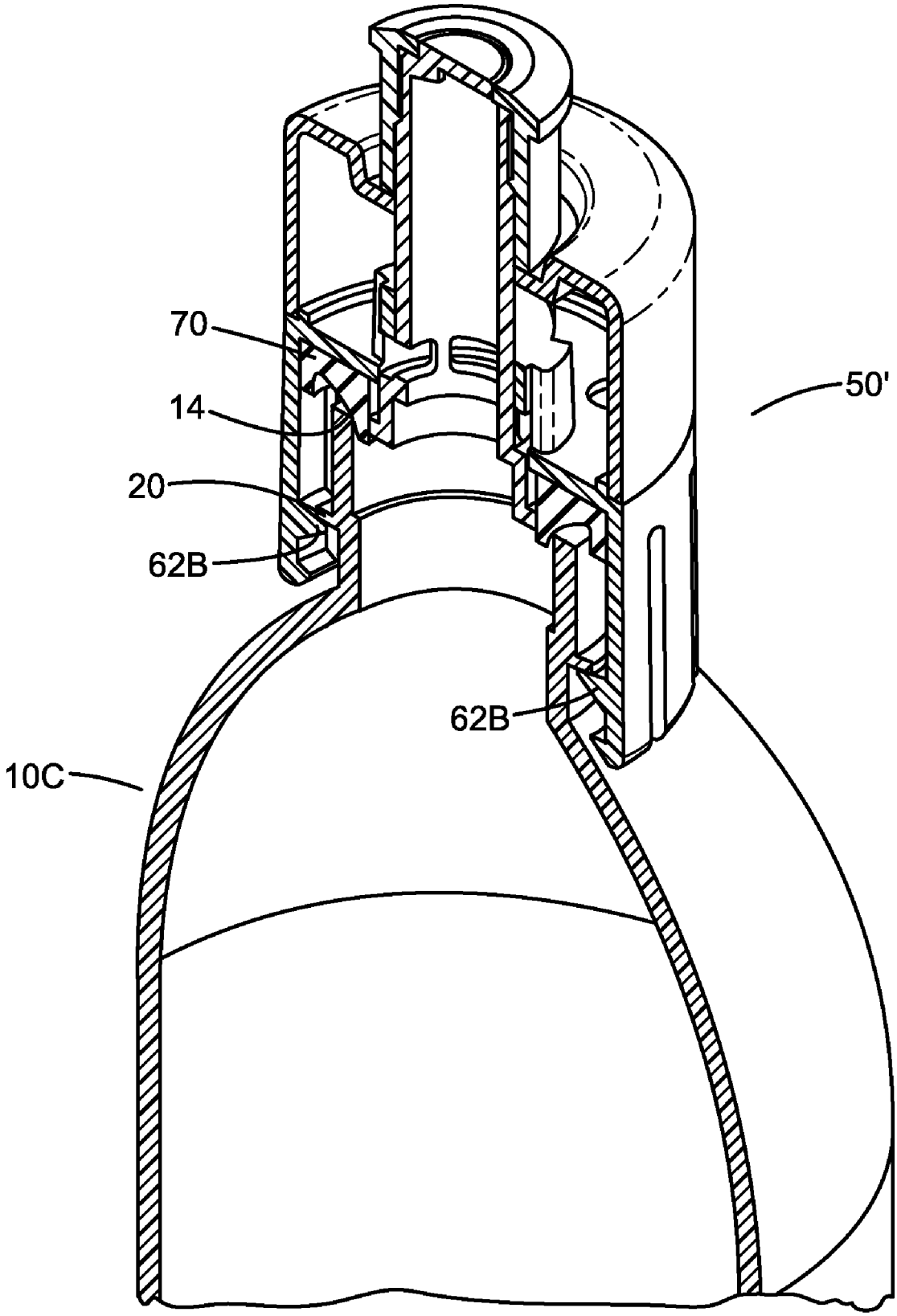

The versatility of the bottle cap assembly 50' in accommodating bottle necks of different neck opening sizes and flange dimensions is illustrated in the cutaway views of FIGS. 8, 9 and 10. Here, the bottle 10A has a relatively longer distance between the flange 20 and the neck opening surface 14. The bottle cap assembly is secured to the bottle by engagement of the tip barb portions with the flange 20. The neck opening of the bottle also has a relatively smaller diameter, with the surface 14 engaging the seal closer to the inward edge of the seal.

FIG. 9 shows the cap assembly 50' in sealed position on the neck of another bottle 10B, this bottle having a somewhat larger neck opening diameter than that of bottle 10A, so that the neck surface 14 engages the seal surface of the seal member 70 in a position further away from the center of the seal member. However, the distance from the neck opening to the flange 20 is still relatively large, and the tip barb portions 62A are engaging the flange to hold the assembly 50' in sealed position to the bottle neck.

FIG. 10 shows the cap assembly 50' in sealed position on the neck of yet another bottle 10C, this bottle, having a somewhat smaller neck opening diameter than that of bottle 10C, so that the neck surface 14 engages the seal surface of the seal member 70 in a position closer to the center of the seal member. However, the distance from the neck opening to the flange 20 is relatively smaller than that of bottles 10A and 10B, and the intermediate barb portions 62B are engaging the flange to hold the assembly 50' in sealed position to the bottle neck.

In the embodiment 50', the cap member is provided with two barb positions relative to the bottle neck opening 14, i.e. the barb position of tip portion 62A and the barb position of intermediate barb portion 62B. In other embodiments, more than two barb portions positions may be provided, either on each finger portions or at staggered finger portions. This may provide a single bottle cap assembly configuration to accommodate more than two or three different bottle sizes. The bottle sizes are typically determined by a drink manufacturer, say a bottled water purveyor, sports drink purveyor or other drink vendor. Providing flexibility in the dispensing cap assembly to accommodate multiple bottle types provides the advantage of reducing the number of different types of dispensing cap assemblies needed to fit to the multiple bottle types.

In another embodiment shown in FIGS. 11-16, a cap system 150 has the same overall function as the cap system 50 and other cap systems of the prior embodiments. One important difference is that a shuttle valve of this embodiment, valve 190, will lock into position when moved (pressed) into its lowermost or low position, thereby remaining fully open to the supplement storage compartment in spite of shaking during mixing of liquid and supplement, and in spite of movement of nipple 200, and other usage and jostling. This promotes and/or ensures a good mix of water and supplement and using all supplement.

Nipple 200 is the same or similar to nipple 100 and other nipples in the previous embodiments. It is sized to fit over shuttle valve 190. Around nipple 200 is a nipple seat and storage compartment member 210. This storage compartment member 210 is preferably of a rigid plastic, such as other rigid plastic members disclosed herein. The nipple at its lower end preferably has a rib that mates with a rib of the storage compartment member 210 to limit the upward movement of the nipple, or by other means that are well known in the art for sports bottle type nipples.

Figure 15:
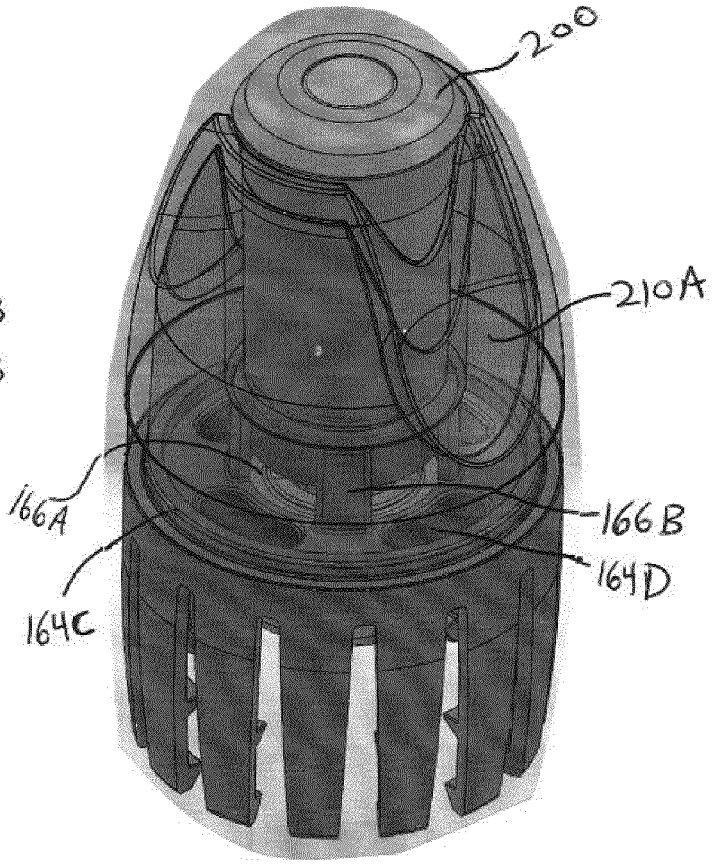
FIG. 15 is a perspective view of the cap system of FIG. 13 in a fully assembled state.
Figure 16:
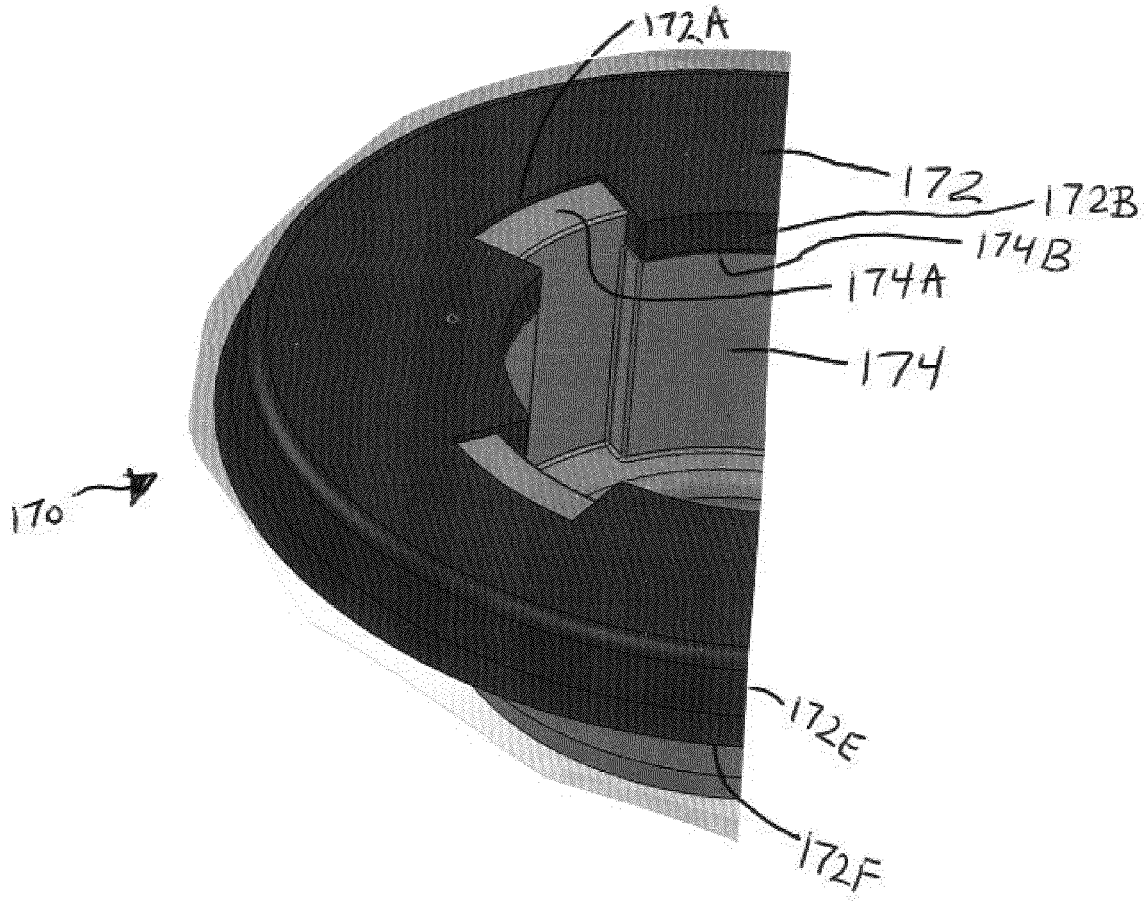
FIG. 16 is a perspective and partial view of the seal member assembly of the embodiment of FIG. 11 and enlarged in relation to FIG. 14 for better viewing of details of the seal member assembly.

Storage compartment member 210 has a hollow circumferential section 220 open at its lower end for mating with an upper portion of a cap member 160 thereby forming a storage compartment 220A for supplement. The storage compartment member 210 has two opposing curved indentations 210A so that even when the nipple 200 is in the downmost position (e.g., as shown in FIG. 15), portions of the nipple are exposed to easily grasp the nipple with a finger and opposing thumb to lift the nipple from the closed position to an open position (uppermost position of the nipple, e.g., FIG. 13), so that a user may drink from the bottle. The storage member 210 has an inner bottom ring portion 210B to mate with an upper surface of ring 166 of web portion 164 of the cap member. There may be small ribs to form a slight interference fit and thus a better seal to keep the supplement in the chamber.

In this embodiment, there is a cap member 160 that functions the same or similar to the cap member 60 and other cap members of the prior embodiments. Generally, cap member 160 has a lower portion with a plurality of finger portions 162 projecting from a web portion 164. The finger portions 162 are the same or substantially the same as in the prior embodiments, and preferably as depicted here with two barbs or tabs that operate the same as in the prior embodiments, forming an attach portion for attaching the cap system and in particular the cap member to the bottle. The web portion has a hollow upwardly projecting ring portion 166, i.e. projecting above the web portion away from the finger portions. The ring portion 166 has a plurality of spaced dispensing openings 166A formed between adjacent posts 166B, and these openings will allow the supplement material to pass through when the shuttle valve member openings 190A are aligned with the these openings 166A of the storage chamber, as described more fully below with reference to FIG. 13.

The cap member 160 further includes an outer circumferential surface 164A and a circumferential vertical wall 164B extending upwardly from the web portion 164 and together defining the outer circumferential surface 164A. Surface 164A receives a bottom circumferential edge of the storage compartment member 210. The storage compartment member 210 has an inwardly projecting circumferential rib 220B that snap fits over and mates with an outwardly projecting circumferential rib 164C from wall 164B, the rib 164C being of slightly greater diameter than that of rib 220B, thereby providing an attach feature of the storage compartment member 210 to the cap member.

The cap system also includes a seal member assembly 170 that fits into cap member 160, i.e., sized to fit snugly within a barrel of the cap member formed by the fingers and pressed upwardly against an underside of the web portion 164 of the cap member. The seal member assembly is preferably two members, a seal member 172 and a rigid member 174. The seal member 172 is resilient and preferably fabricated of an elastomeric material, such as, by way of example only, thermoplastic rubber (TPR) (molded rubber), SBR, neoprene rubber, or closed cell foam, and has a center opening configured for concentricity with the opening through the boss. The rigid member 174 is preferably a rigid plastic of a type disclosed herein or other type of rigid member.

The rigid member 174 has upper tabs 174A that engage slots 172A of the seal member 172 and an upper interior substantially annular surface 174B that receives a corresponding annular downwardly depending tab 172B of the seal member 172. The seal member assembly 170 includes a center opening through which the bottle contents may pass, and a generally flat upper surface 74.

Figure 11:
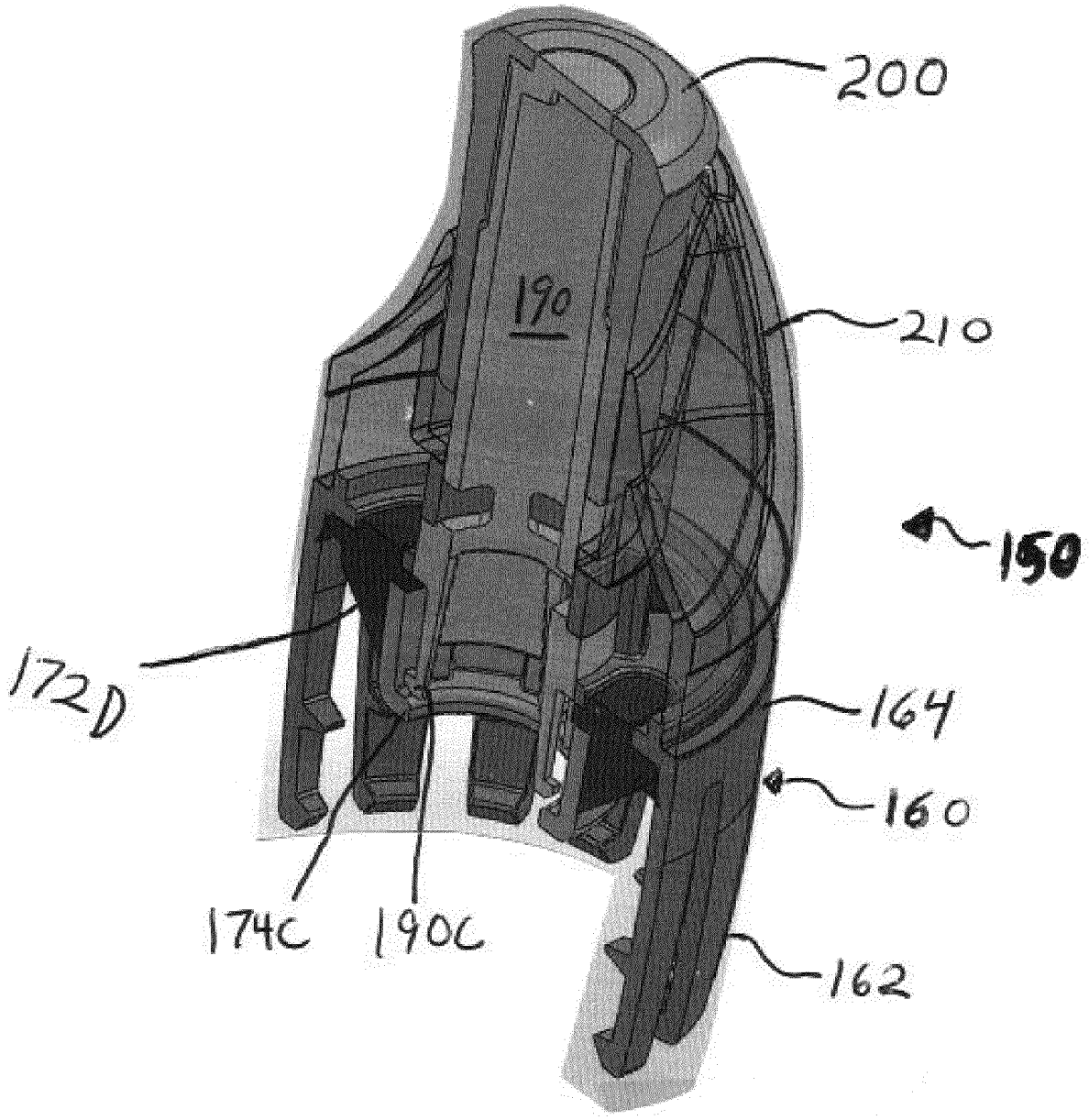
FIG. 11 is a cutaway or sectional view of a further embodiment of the cap system, showing an exemplary dispensing cap system for installation on a bottle as in prior embodiments, with a nipple and valve member in a shipping and/or storage position.
Figure 12:
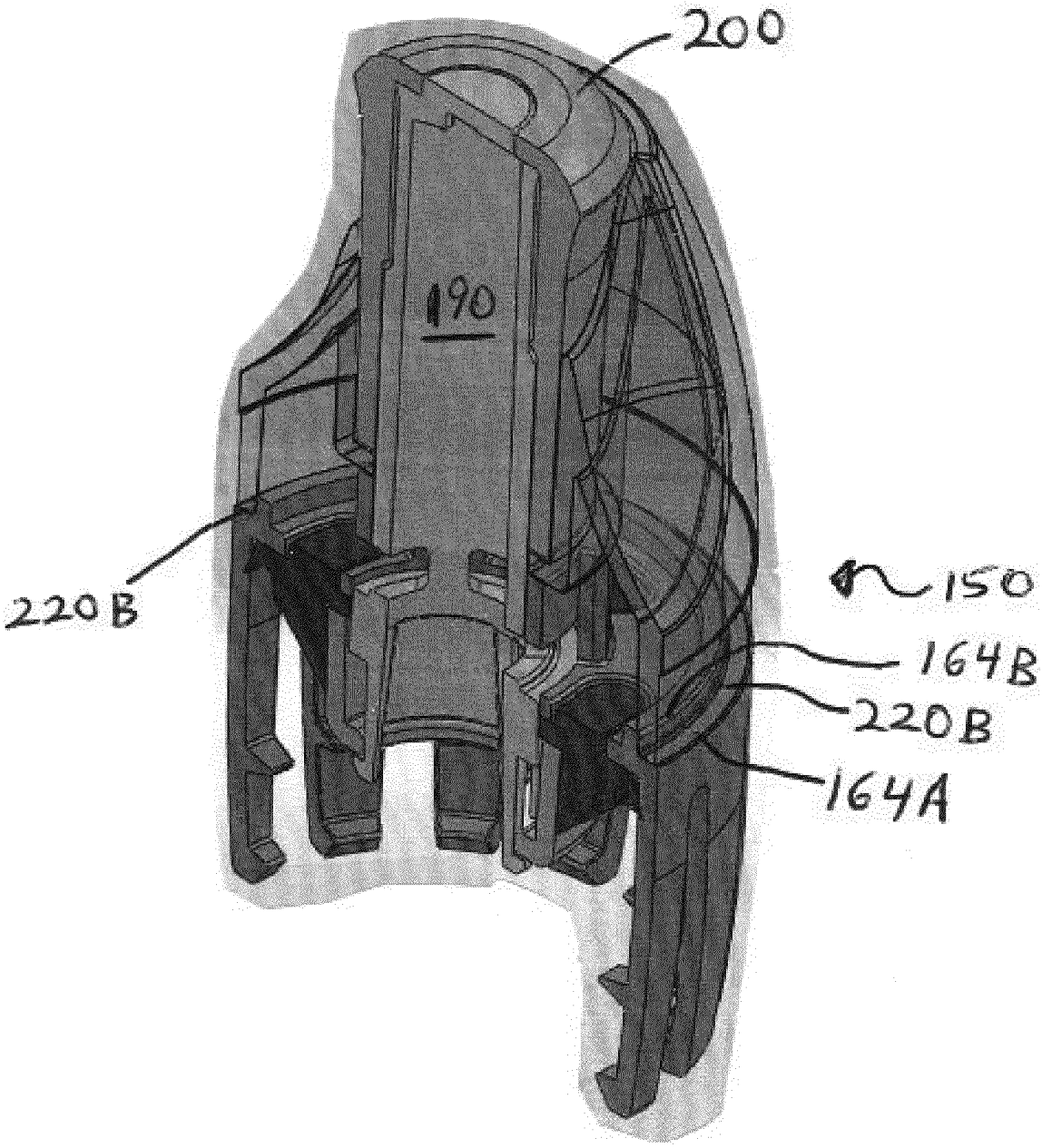
FIG. 12 is a cutaway or sectional view of the embodiment of FIG. 11, but with the nipple moved downward so that the valve member is in a dispensing state or position.

The outer periphery of the seal member 172 includes a downwardly extending peripheral wall 172E that also extends or tapers outwardly, and even more so at its lower and outermost portion 172F to frictionally engage the inner portion of the web member barrel, e.g., as shown in FIG. 11. This shape allows the seal member 172 to slide into the barrel relatively easily, but the outermost portion 172F tends to expand if one attempts to move it downward from the barrel. The seal member also has an inwardly tapered lower surface 172D defining a partial conical seal surface which may be contacted by the bottle neck lip when the cap system is attached to the bottle neck, e.g., as shown in the embodiment of FIG. 3.

The web portion 164 has an opening or openings 164D through which supplement can be inserted into the chamber. The chamber could also be filled in advance, prior to assembly, then snapped on to the cap member at the web portion, in which case the openings 164D would not be needed but could still be present. The member 210 may be fabricated of a semi-transparent or transparent plastic material such as, by way of example only, styrene, and is configured for attachment to the cap member by snap fit mentioned above, although adhesive, welding or other connection method could be used. As noted elsewhere herein, single use is preferred for the cap system, although multiple use is possible. Shipment with the chamber filled, or subsequent filling by the user are possible.

Figure 13:
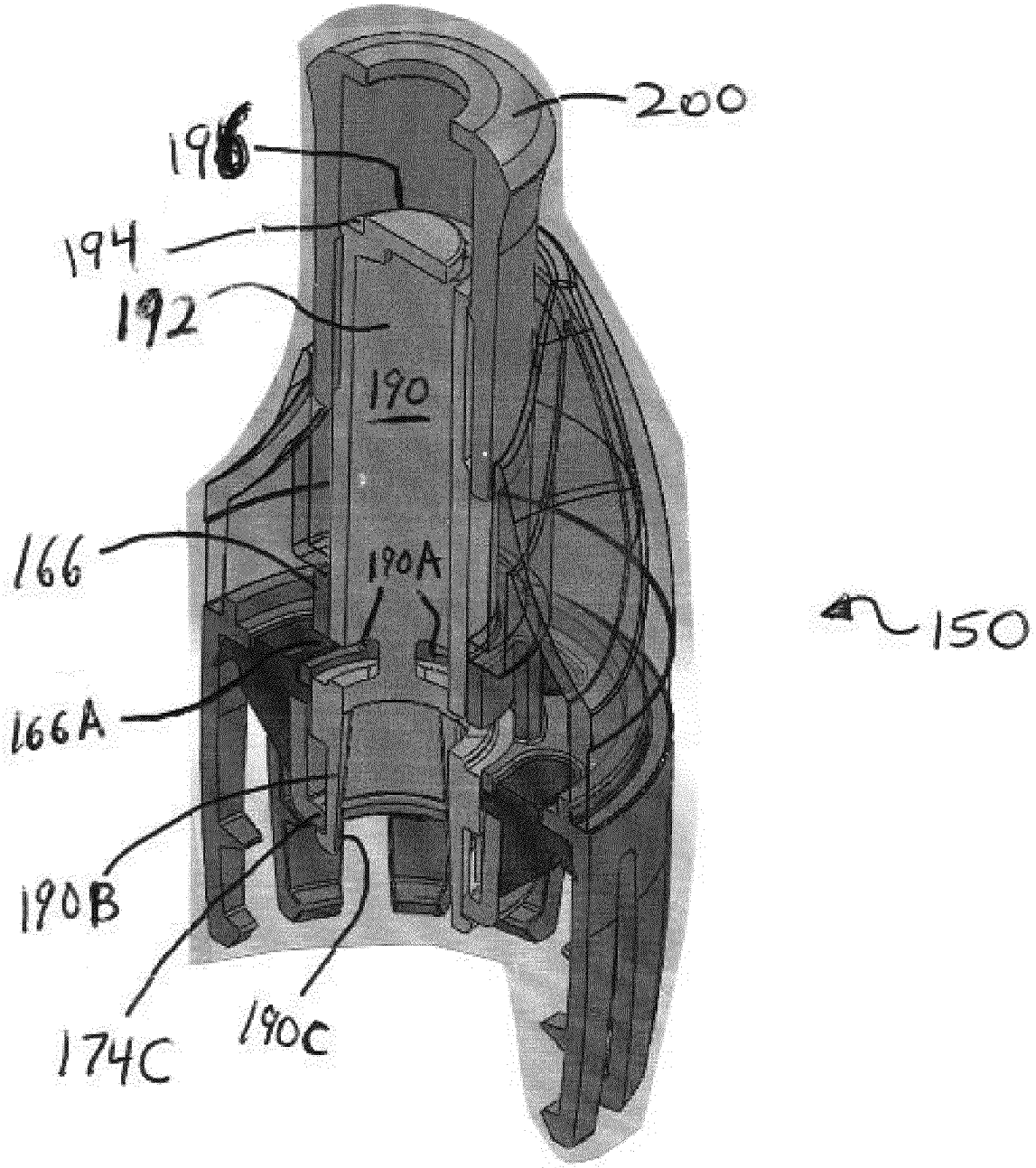
FIG. 13 is a cutaway or sectional view of the embodiment of FIG. 11, but with the nipple pulled up and in an open state relative to the valve member.
Figure 14:
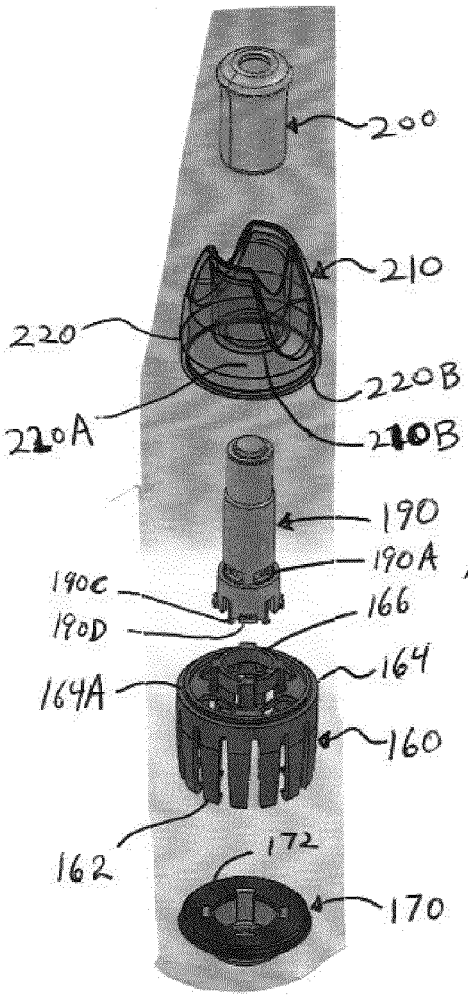
FIG. 14 is an exploded perspective view of the cap system of FIG. 13, but with a seal member assembly in an assembled state.

The dispensing cap system 150 further includes the shuttle valve member 190 having a hollow generally cylindrical wall portion 192, and a top web portion 194 at one end thereof which extends across the end of the wall portion and is for mating with the nipple when the nipple is closed to flow of liquid. A bottom of the shuttle valve has tabs or fingers 190B that have a gripping projection 190C at their ends. The gripping portions engage a bottom inner annular portion 174C of the rigid member 174 of the seal assembly to hold the shuttle valve 190 securely in the open position as best shown in FIG. 13. There are also boss surfaces or tabs 190D to act as downward motion stoppers that engage the upper portion of annular portion 174C.

A tip 196 of reduced diameter relative to the wall portion 192 extends above the surface of the web portion 194. The sidewall of the tip has several ports (e.g., such as shown as 96A in earlier embodiments) formed therein, and permit the beverage to pass through from the bottle when the valve is in an open position. The diameter of the wall portion 192 is sized in cooperation with the diameter of the opening in the storage member, so that the cylindrical wall portion tightly but slidably fits within the opening.

The shuttle valve has a range of sliding movement within the storage member, and the nipple has a range of sliding movement on the shuttle valve, such that, when the nipple and shuttle valve are in a closed position as in FIG. 11, the ports are sealed by the nipple. In an open position as in FIG. 12, the nipple does not cover the ports 196A, allowing liquid to pass through from the bottle, so the user can drink the beverage.

In the shipping or storage state of FIG. 11, valve 190 is positioned so that the boss surfaces or tabs 190D may be positioned such that against the upper portion of annular portion 174C and act as temporary downward motion stoppers. However, friction also would act to prevent premature opening of the valve. Further, packaging for the cap system in shipping and otherwise handling would preferably be such to help prevent premature opening of the valve. The interior volume of the storage member 210, when filled with a quantity of supplement material, cannot flow out through openings 166A because the openings 190A of the shuttle valve are not aligned. They are blocked by the solid wall portion of the shuttle valve 190.

When the system 150 is installed on a bottle such as bottle 10, the nipple 200 and shuttle valve 190 may be pressed down by the user, resulting in the tabs 190D passing downward below the annular portion 174C and engaging the lower surface of the annular portion. This communicates the openings 190A in the shuttle valve with the openings 166 in the web portion and allows supplement to mix with liquid from the bottle. There is an annular gap between the openings 190A and openings 166 so that actual alignment of the openings 190A with openings 166 is not necessary for the system to operate, although alignment would be preferred. The user shakes the bottle until a good mix is achieved. The openings 190A positively stay in communication with the openings 166, thus allowing complete mixing.

FIG. 13 shows the drinking position of the nipple 200, which has been pulled upward to its topmost position, opening communication with the ports in the shuttle valve. The shuttle valve 190 stays down. Although the foregoing has been a description and illustration of specific embodiments of the subject matter, various modifications and changes thereto can be made by persons skilled in the art without departing from the scope and spirit of the invention. For example, a lesser preferred connection system would be threads instead of fingers with barbs or fingers with threads, but in such case the cap system would have to be sized for a particular bottle. Such embodiments would not have the more universal attachment capability of the fingers with barbs. More fingers, such as ten, twelve or fourteen, are preferred as such fingers will have a smaller width relative to using fewer fingers, e.g., six. The finger and barb dimensions and material, and the number of fingers and barbs, and spacing between the fingers all affect the resiliency of the fingers. The resiliency is such that the downward force needed to apply the fingers to the bottle neck sufficiently to form a good seal between the seal member and bottle is less than the deformation point and failure point of the bottle. At least ten, or at least twelve or at least fourteen fingers helps to provide good flexibility and resiliency to the fingers to help reduce the downward force of application to the bottle, and yet achieve a strength of attachment to the bottle such that pulling up on the nipple in order to drink will not pull the cap system off of the bottle. The force required to apply the cap member to the bottle must be less than such force that would cause the user to apply so much resisting force to the bottle that the user would cause the bottle to be crushed or otherwise fail.

What is claimed is:

1. A dispensing cap system for dispensing a supplement material through a bottle neck opening and into the bottle, comprising:

a cap member including a connection structure for engagement with the bottle neck, the cap member including a web portion having an opening formed therein and a boss structure extending around the opening and having one or more dispensing ports defined therethrough;

a seal member having a seal surface arranged for sealing contact with the bottle neck, the seal surface having a lateral extent sufficient to provide sealing contact with bottle necks of different opening sizes;

a storage member assembled to the cap member and including an outer wall defining an outer periphery of a storage volume for holding the supplement material, the storage member having an opening formed through the outer wall in alignment with the opening in the cap member;

a generally cylindrical valve member including generally cylindrical wall member, with a flange member at a first end and a valve tip having one or more valve ports at the tip and one or more dispensing ports disposed adjacent the first end, the valve member configured for sliding movement within the boss structure and the opening in the storage member between a storage position in which the dispensing ports are blocked by the boss structure and a dispensing position in which the one or more dispensing ports is in alignment with a corresponding boss port to allow the supplement material to pass through from the storage volume; and a valve nipple configured to fit onto the valve for sliding movement between a valve closed position with the valve ports closed by the valve nipple and an open position in which the valve ports are open, wherein there is also a rigid member attached to the seal member for engaging a lower portion of the valve when the valve is in the open position for holding the valve in the open position.

2. The system of claim 1, in which the connection structure comprises a set of finger portions depending downwardly from the web portion, the finger portions including finger barb portions extending inwardly, the cap member formed of a plastic material and the finger portions having sufficient flexibility for the distal ends to splay outwardly to allow the barb portions to pass over a neck flange as the cap member is installed onto the neck, and the barb portions engage the flange to secure the cap member onto the bottle neck.

3. The system of claim 2, wherein the finger barb portions are disposed at the distal ends of the finger portions.

4. The system of claim 2, wherein the finger barb portions include a set of barb portions disposed intermediate the finger portions distal ends and the web portion.

5. The system of claim 2, wherein the finger barb portions include a first set of barb portions located at the distal ends of at least some of said finger portions, and a second set of barb portions located intermediate the distal ends of at least some of said finger portions and the web portion.

6. The system of claim 2, wherein the seal member is fabricated of an elastomeric material, such that the seal surface is compressible to allow sealing engagement with the bottle neck as the finger portions engage the bottle neck flange.

7. The system of claim 1, wherein the seal surface has a generally conical-like shape.

8. A dispensing cap system for dispensing a supplement material through a bottle neck opening and into the bottle in combination with a bottle, comprising:

a bottle having a threaded neck with an opening at a mouth portion; and a dispensing cap system comprising a cap member including a connection structure for engagement with the bottle neck, the cap member including a web portion having an opening formed therein and a boss structure extending around the opening and having one or more dispensing ports defined therethrough;

a seal member having a seal surface arranged for sealing contact with the bottle neck, the seal surface having a lateral extent sufficient to provide sealing contact with bottle necks of different opening sizes;

a storage member assembled to the cap member and including an outer wall defining an outer periphery of a storage volume for holding the supplement material, the storage member having an opening formed through the outer wall in alignment with the opening in the cap member;

a generally cylindrical valve member including generally cylindrical wall member, with a flange member at a first end and a valve tip having one or more valve ports at the tip and one or more dispensing ports disposed adjacent the first end, the valve member configured for sliding movement within the boss structure and the opening in the storage member between a storage position in which the dispensing ports are blocked by the boss structure and a dispensing position in which the one or more dispensing ports is in alignment with a corresponding boss port to allow the supplement material to pass through from the storage volume; and a valve nipple configured to fit onto the valve for sliding movement between a valve closed position with the valve ports closed by the valve nipple and an open position in which the valve ports are open, wherein there is also a rigid member attached to the seal member for engaging a lower portion of the valve when the valve is in the open position for holding the valve in the open position, and wherein the cap member is mounted on the bottle such that the opening in the cap member is over the mouth of the bottle, and the seal member is against the neck at the mouth of the bottle, and the connection structure is engaged with the threads of the bottle for holding the cap system on the bottle.

9. The combination of claim 8, in which the connection structure comprises a set of finger portions depending downwardly from the web portion, the finger portions including finger barb portions extending inwardly, the cap member formed of a plastic material and the finger portions having sufficient flexibility for the distal ends to splay outwardly to allow the barb portions to pass over a neck flange as the cap member is installed onto the neck, and the barb portions engage the flange to secure the cap member onto the bottle neck.

10. The combination of claim 9, wherein the finger barb portions are disposed at the distal ends of the finger portions.

11. The combination of claim 9, wherein the finger barb portions include a set of barb portions disposed intermediate the finger portions distal ends and the web portion.

12. The combination of claim 9, wherein the finger barb portions include a first set of barb portions located at the distal ends of at least some of said finger portions, and a second set of barb portions located intermediate the distal ends of at least some of said finger portions and the web portion.

13. The combination of claim 9, wherein the seal member is fabricated of an elastomeric material, such that the seal surface is compressible to allow sealing engagement with the bottle neck as the finger portions engage the bottle neck flange.

14. The combination of claim 8, wherein the seal surface has a generally conical-like shape.

15. A dispensing cap system for dispensing a supplement material through a bottle neck opening and into the bottle, comprising:

a cap member including a web portion and a connection structure for non-threading engagement with the bottle neck;

a seal member having a seal surface arranged for sealing contact with the bottle neck, the seal surface having a lateral extent sufficient to provide sealing contact with bottle necks of different opening sizes;

a storage member assembled to the cap member and including an outer wall defining an outer periphery of a storage volume for holding the supplement material;

a valve member having one or more valve ports and one or more dispensing ports, the valve member configured for sliding movement between a storage position in which the storage volume is sealed and a dispensing position in which one or more dispensing ports in the cap member are open to allow the supplement material to pass through from the storage volume;

a valve nipple configured to fit onto the valve for sliding movement between a valve closed position and a valve opened position in which contents of the bottle are allowed to pass through the valve member for consumption by a user;

said connection structure comprising a set of finger portions depending downwardly from the web portion, the finger portions having finger barb portions extending inwardly, the cap member having sufficient flexibility for the distal ends to splay outwardly to allow the barb portions to pass over a neck flange as the cap member is installed onto the neck, and the barb portions engage the flange to secure the cap member onto the bottle neck, wherein there is also a rigid member attached to the seal member for engaging a lower portion of the valve when the valve is in the open position for holding the valve in the open position.

16. The system of claim 15, wherein at least some of the finger barb portions are disposed at the distal ends of the finger portions.

17. The system of claim 15, wherein the finger barb portions include a set of barb portions disposed intermediate the finger portions distal ends and the web portion.

18. The system of claim 15, wherein the finger barb portions include a first set of barb portions located at the distal ends of at least some of said finger portions, and a second set of barb portions located intermediate the distal ends of at least some of said finger portions and the web portion.

19. The system of claim 15, wherein the seal member is fabricated of an elastomeric material, such that the seal surface is compressible to allow sealing engagement with the bottle neck as the finger portions engage the bottle neck flange.

20. The system of claim 15, wherein the seal surface has a generally conical-like shape.

* * * * *